US009700074B2

(12) United States Patent
Liu

(10) Patent No.: US 9,700,074 B2
(45) Date of Patent: Jul. 11, 2017

(54) ELECTRONIC CIGARETTE WITH BRIGHTNESS-ADJUSTABLE HEAD LAMP AND BRIGHTNESS ADJUSTMENT METHOD THEREFOR

(71) Applicant: KIMREE HI-TECH INC., Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 14/895,936

(22) PCT Filed: Jun. 5, 2013

(86) PCT No.: PCT/CN2013/076760

§ 371 (c)(1),
(2) Date: Dec. 4, 2015

(87) PCT Pub. No.: WO2014/194483

PCT Pub. Date: Dec. 11, 2014

(65) Prior Publication Data

US 2016/0113324 A1 Apr. 28, 2016

(51) Int. Cl.
*A24F 47/00* (2006.01)
*H05B 33/08* (2006.01)

(52) U.S. Cl.
CPC ..... *A24F 47/002* (2013.01); *A24F 47/008* (2013.01); *H05B 33/0812* (2013.01); *H05B 33/0815* (2013.01); *H05B 33/0854* (2013.01); *H05B 33/0845* (2013.01)

(58) Field of Classification Search
CPC . A24F 47/002; A24F 47/008; H05B 33/0812; H05B 33/0815; H05B 33/0854
USPC ..... 315/76
See application file for complete search history.

(56) References Cited

U.S. PATENT DOCUMENTS

| | | | | |
|---|---|---|---|---|
| 5,404,080 A * | 4/1995 | Quazi | H05B 41/2925 315/151 |
| 2013/0042865 A1* | 2/2013 | Monsees | A61M 15/06 128/203.27 |
| 2014/0261486 A1* | 9/2014 | Potter | A24F 47/008 131/328 |

(Continued)

FOREIGN PATENT DOCUMENTS

| | | |
|---|---|---|
| CN | 2807690 Y | 8/2006 |
| CN | 201238610 Y | 5/2009 |
| CN | 201667265 U | 12/2010 |

OTHER PUBLICATIONS

International Search Report of PCT Patent Application No. PCT/CN2013/076760 issued on Mar. 20, 2014.

*Primary Examiner* — Dylan White

(57) ABSTRACT

Disclosed are an electronic cigarette with a brightness-adjustable head lamp and a brightness adjustment method therefor. The electronic cigarette includes a lamp display module and a manual control module, wherein the manual control module is used for manually adjusting the brightness of the lamp display module. By adding the manual control module, the present application achieves the manual adjustment of the brightness of the lamp display module and can satisfy the requirements of different smokers on the brightness of the lamp display module.

10 Claims, 5 Drawing Sheets

(56) References Cited

U.S. PATENT DOCUMENTS

| | | | | |
|---|---|---|---|---|
| 2014/0270727 | A1* | 9/2014 | Ampolini | A24F 47/008 392/387 |
| 2015/0296888 | A1* | 10/2015 | Liu | A24F 47/008 131/329 |
| 2016/0143359 | A1* | 5/2016 | Xiang | H05B 1/0227 392/387 |
| 2016/0302483 | A1* | 10/2016 | Liu | A24F 47/008 |

* cited by examiner

ELECTRONIC CIGARETTE WITH BRIGHTNESS-ADJUSTABLE HEAD LAMP AND BRIGHTNESS ADJUSTMENT METHOD THEREFOR

TECHNICAL FIELD

The present application relates to an electronic cigarette, and more particularly relates to an electronic cigarette with a brightness-adjustable head lamp and a brightness adjustment method therefor.

BACKGROUND

As shown in FIG. 1, it is a structural diagram of an electronic cigarette with a brightness-unadjustable lamp display module in the prior art. When smoking, the air flow change is sensed by the airflow sensor which then triggers the control module to control the operation of the head lamp. However, this electronic cigarette, mainly adjusts the brightness of the ash lamp via the control module triggered by the airflow sensor acting as an automatic switch. Accordingly, the brightness of the ash lamp can not be adjusted manually, thus can not meet the demands of different smokers on the lamp brightness, and result in a single function.

Therefore, the prior art has defects which need to be improved.

SUMMARY

An objective of this invention is, aimed to the disadvantage that the lamp display module has an unadjustable brightness in the prior art, providing an electronic cigarette with a brightness-adjustable head lamp and a brightness adjustment method therefor.

According to a first aspect, an electronic cigarette with a brightness-adjustable head lamp is provided, which including a lamp display module arranged at an end of the electronic cigarette and a manual control module used for manually adjusting a brightness of the lamp display module.

The electronic cigarette with a brightness-adjustable head lamp according to the present application further includes a control module electrically connected to the manual control module and the lamp display module, wherein the control module is used for adjusting the brightness of the lamp display module according to an input signal of the manual control module.

The electronic cigarette with a brightness-adjustable head lamp according to the present application further includes a transformer module via which the control module and the lamp display module are electrically connected, wherein the manual control module further includes a brightness adjustment switch electrically connected to the control module, wherein the brightness adjustment switch is used for triggering the control module outputting an brightness adjustment signal, and the transformer module is used for adjusting received input voltage according to the brightness adjustment signal and outputting the same to the lamp displa module.

In the electronic cigarette with a brightness-adjustable head lamp according to the present application, the transformer module includes a MOS tube of P type and a capacitor, the brightness adjustment signal is a pulse wave signal for controlling the MOS tube to switch on or off, wherein a drain of the MOS tube is connected to an voltage output terminal of the control module for receiving the input voltage, a gate of the MOS tube is connected to a control output terminal of the control module for receiving the pulse wave signal, a source of the MOS tube is connected to one terminal of the capacitor, the other terminal of the capacitor is grounded, and the lamp display module is connected in parallel with the capacitor.

In the electronic cigarette with a brightness-adjustable head lamp according to the present application, the manual control module includes a smoking switch electrically connected to the control module.

The electronic cigarette with a brightness-adjustable head lamp according to the present application, further includes a power supply electrically connected to the lamp display module.

The electronic cigarette with a brightness-adjustable head lamp according to the present application, further includes a power supply electrically connected to the control module.

In the electronic cigarette with a brightness-adjustable head lamp according to the present application, the power supply is a battery, a high energy capacitor or an external power supply for supplying electric power to the electronic cigarette.

In the electronic cigarette with a brightness-adjustable head lamp according to the present application, the manual control module includes a voltage-dividing rheostat with one terminal connected to one terminal of the power supply and one terminal of the lamp display module, respectively, with the other terminal grounded and with a sliding terminal connected to the other terminal of the lamp display module; wherein the voltage-dividing rheostat is used for controlling a voltage distributed to the lamp display module, thus adjusting the brightness of the lamp display module.

In the electronic cigarette with a brightness-adjustable head lamp according to the present application, the manual control module includes a voltage-dividing rheostat with one terminal connected to one terminal of the control module and one terminal of the lamp display module, respectively, with the other terminal grounded and with a sliding terminal connected to the other terminal of the lamp display module; wherein the voltage-dividing rheostat is used for controlling a voltage distributed to the lamp display module, thus adjusting the brightness of the lamp display module.

In the electronic cigarette with a brightness-adjustable head lamp according to the present application, the manual control module includes a shunt rheostat with one terminal connected to one terminal of the power supply and one terminal of the lamp display module, respectively, with a sliding terminal grounded and connected to the other terminal of the lamp display module; wherein the shunt rheostat is used for controlling a current distributed to the lamp display module, thus adjusting the brightness of the lamp display module.

In the electronic cigarette with a brightness-adjustable head lamp according to the present application, the manual control module includes a shunt rheostat with one terminal connected to one terminal of the control module and one terminal of the lamp display module, respectively, with a sliding terminal grounded and connected to the other terminal of the lamp display module; wherein the shunt rheostat is used for controlling a current distributed to the lamp display module, thus adjusting the brightness of the lamp display module.

In the electronic cigarette with a brightness-adjustable head lamp according to the present application, the lamp display module includes an ash lamp.

In the electronic cigarette with a brightness-adjustable head lamp according to the present application, the lamp display module includes an illuminating lamp, wherein the manual control module includes an illuminating switch used for controlling an operation of the illuminating lamp.

The electronic cigarette with a brightness-adjustable head lamp according to the present application further includes an airflow sensor and an atomizer electrically connected to the control module; wherein, the airflow sensor is used for outputting a corresponding triggering signal to the control module according to a sensed air flow change, thus controlling an operation of the atomizer and a corresponding brightness change of the lamp display module.

According to a second aspect, a brightness adjustment method for an electronic cigarette with a brightness-adjustable head lamp is provided, wherein, the electronic cigarette includes a lamp display module and a manual control module, wherein, the brightness adjustment method includes manually adjusting a brightness of the lamp display module via the manual control module.

The brightness adjustment method for an electronic cigarette with a brightness-adjustable head lamp further includes automatically controlling the brightness of the lamp display module according to an airflow change sensed by an airflow sensor, and then manually adjusting the brightness of the lamp display module via the manual control module.

In the brightness adjustment method for an electronic cigarette with a brightness-adjustable head lamp, the manually adjusting via the manual control module includes sliding a voltage-dividing rheostat or a shunt rheostat.

In the brightness adjustment method for an electronic cigarette with a brightness-adjustable head lamp, the manually adjusting via the manual control module includes pressing a brightness adjustment switch.

In the brightness adjustment method for an electronic cigarette with a brightness-adjustable head lamp, the manually adjusting via the manual control module includes pressing a smocking switch firstly and then pressing a brightness adjustment switch.

When implementing the electronic cigarette with a brightness-adjustable head lamp according to the present application, following advantageous or effects can be obtained. By adding the manual control module, the present application achieves the manual adjustment of the brightness of the lamp display module and can satisfy the requirements of different smokers on the brightness of the lamp display module, thus overcoming the disadvantage that the lamp display module has an unadjustable brightness in the prior art.

BRIEF DESCRIPTION OF THE DRAWINGS

The present application is further illustrated combining the embodiments of present application and the attached drawings.

DETAILED DESCRIPTION OF THE PREFERRED EMBODIMENT

Hereinafter, embodiments of the present application will be described in detail with reference to the accompanying drawings.

Figure 1:
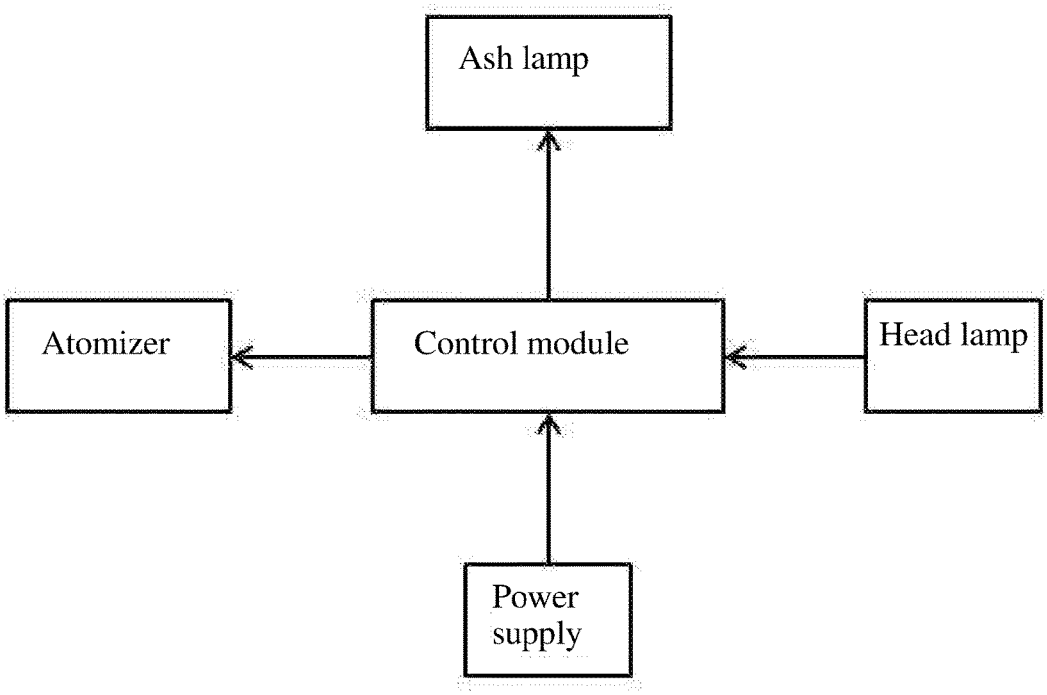
Figure 1 (Prior Art)
FIG. 1 is a structural diagram of the electronic cigarette with a brightness-unadjustable lamp display module in the prior art.
Figure 2:
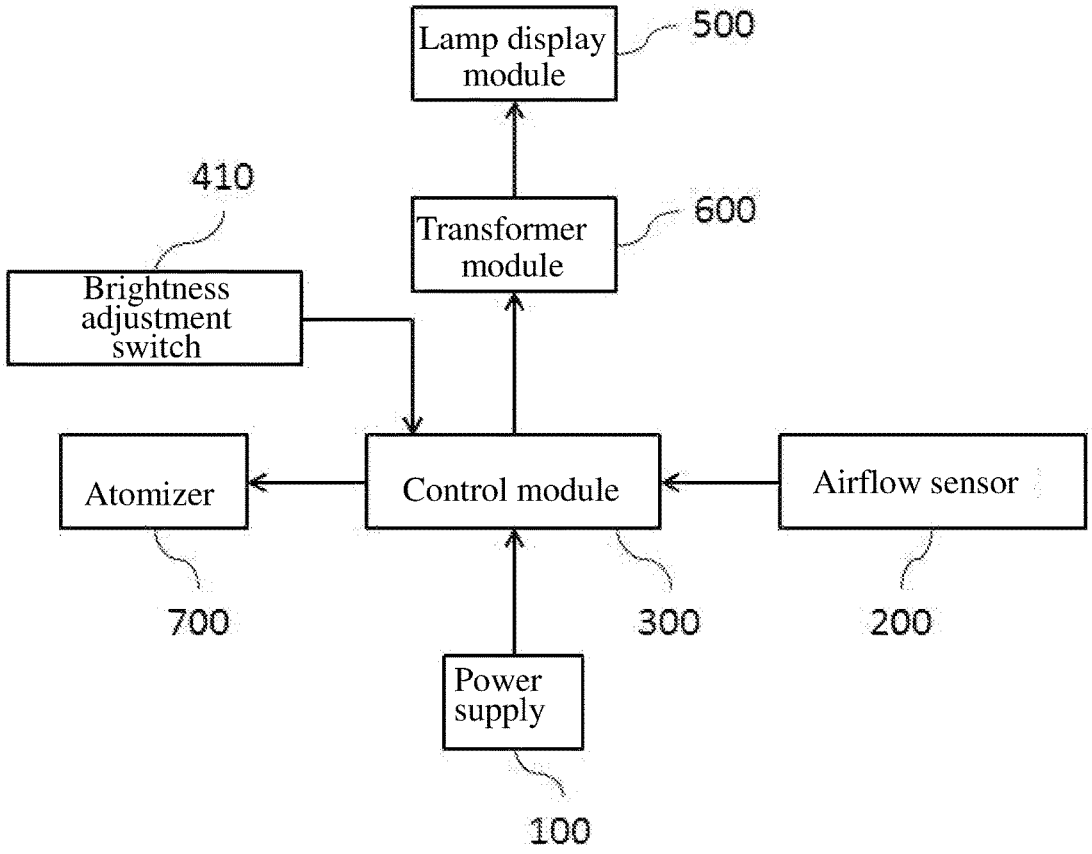
FIG. 2 is a structural diagram of the electronic cigarette with a brightness-adjustable head lamp according to a first embodiment of present application.

FIG. 2 is a structural diagram of the electronic cigarette with a brightness-adjustable head lamp according to a first embodiment of present application.

The electronic cigarette with a brightness-adjustable head lamp of the first embodiment includes a power supply 100, an airflow sensor 200, an atomizer 700, a control module 300, a transformer module 600, a manual control module 400 and a lamp display module 500. The control module 300 is electrically connected to the power supply 100, the airflow sensor 200, the atomizer 700, the transformer module 600, and the manual control module 400, respectively. The lamp display module 500 is electrically connected to the transformer module 600. The manual control module 400 is used for manually adjusting the brightness of the lamp display module 500.

The power supply 100 is a battery, a high energy capacitor or an external power supply for supplying electric power to the electronic cigarette.

The airflow sensor 200 is used for outputting a corresponding triggering signal to the control module 300 according to a sensed air flow change, thus controlling an operation of the atomizer 700 and a corresponding brightness change of the lamp display module 500.

The manual control module 400 includes a brightness adjustment switch 410 electrically connected to the control module 300.

The brightness adjustment switch 410 is used for triggering the control module 300 outputting a brightness adjustment signal, and the transformer module 600 is used for adjusting received input voltage according to the brightness adjustment signal and outputting the same to the lamp display module 500. The brightness adjustment switch 410 includes a positive adjustment switch for increasing the brightness of the lamp display module 500, and a negative adjustment switch for decreasing the brightness of the lamp display module 500.

If the user feels the whole brightness of the lamp display module 500 is too strong or too weak, he/she can turn on the brightness adjustment switch 410. Then the control module 300 outputs the input voltage and the brightness adjustment signal to the transformer module 600 at the same time. The transformer module 600 receives the input voltage and adjusts the same according to the brightness adjustment signal, and then outputs the adjusted voltage to the lamp display module 500 for adjusting its brightness. The brightness of the lamp display module 500 can be adjusted to different extent according to the pressed times of the brightness adjustment switch 410. For example, when the positive adjustment switch is pressed for once, the brightness of the lamp display module 500 increases for one level. In present embodiment, one level means the brightness increases for 10%. When the positive adjustment switch is pressed for twice, the brightness of the lamp display module 500 increases for 20%, and so on. If the user feels the whole brightness of the lamp display module 500 is too strong, he/she can press the negative adjustment switch for adjusting the brightness to meet the user's needs. If the user feels the whole brightness of the lamp display module 500 is too weak, he/she can press the positive adjustment switch for adjusting the brightness to meet the user's needs.

Figure 3:
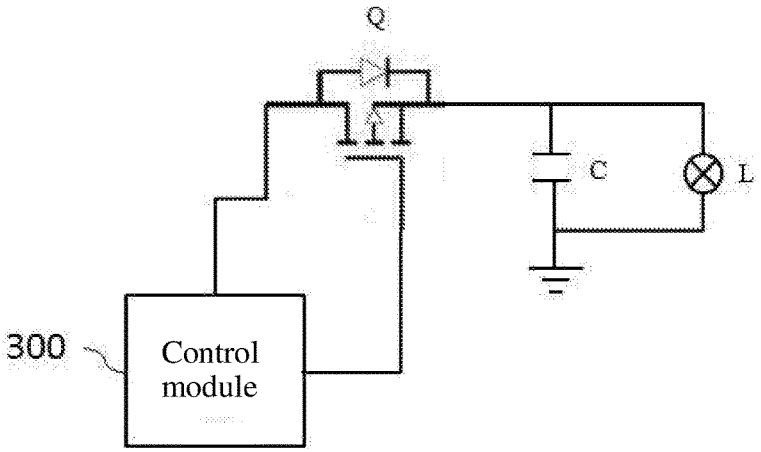
FIG. 3 is a circuit schematic diagram of the transformer module of FIG. 2.

FIG. 3 is a circuit schematic diagram of the transformer module 600 of the electronic cigarette with a brightness-adjustable head lamp according to a first embodiment of present application.

The lamp display module 500 includes an ash lamp L.

In the first embodiment, the transformer module 600 includes a Metal Oxide Semiconductor Field Effect Transistor (hereinafter MOS FET) Q and a capacitor C.

The brightness adjustment signal is a pulse wave signal.

A drain of the MOS FET Q is connected to an voltage output terminal of the control module for receiving the input voltage, a gate of the MOS FET Q is connected to a control output terminal of the control module for receiving the pulse wave signal, a source of the MOS FET Q is connected to one terminal of the capacitor C, the other terminal of the capacitor C is grounded. The ash lamp L is connected in parallel with the capacitor C. The MOS FET Q is configured for controlling the charging and discharging of the capacitor C via the input voltage, thus adjusting the brightness of the ash lamp L.

To be specific, if the positive adjustment switch is pressed, the control module 300 outputs the pulse wave signal with increased duty cycle to the gate of the MOS FET Q, which increasing the conducting time of the MOS FET Q. Only when the MOS FET Q is conducted, does the drain of the MOS FET Q charge the capacitor C via the input voltage. Macroscopically, when the charging time of the capacitor C increases, the cumulative energy also increases, thus the output discharge voltage of the capacitor C increases as well. As a result, the brightness of the ash lamp L increases. If the negative adjustment switch is pressed, the control module 300 outputs the pulse wave signal with decreased duty cycle to the gate of the MOS FET Q, which decreasing the conducting time of the MOS FET Q. Only when the MOS FET Q is conducted, does the drain of the MOS FET Q charge the capacitor C via the input voltage. Macroscopically, when the charging time of the capacitor C decreases, the cumulative energy also decreases, thus the output discharge voltage of the capacitor C decreases as well. As a result, the brightness of the ash lamp L decreases.

Figure 4:
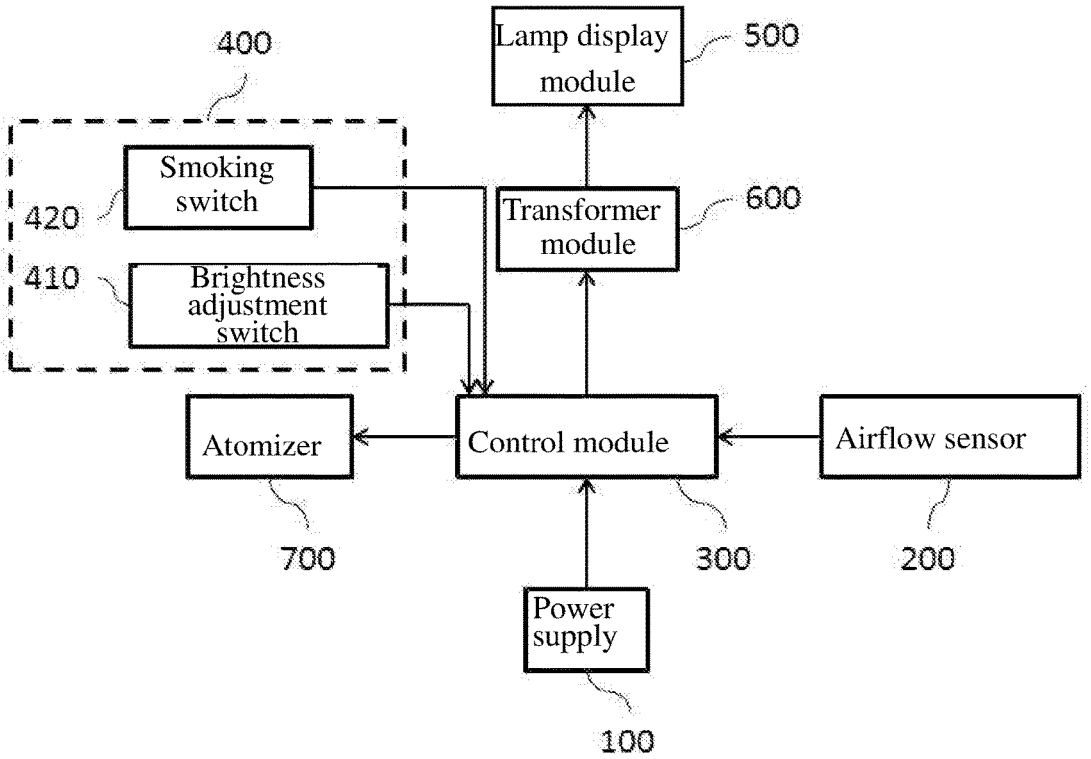
FIG. 4 is a structural diagram of the electronic cigarette with a brightness-adjustable head lamp according to a second embodiment of present application.

FIG. 4 is a structural diagram of the electronic cigarette with a brightness-adjustable head lamp according to a second embodiment of present application.

The electronic cigarette with a brightness-adjustable head lamp of the second embodiment includes a power supply 100, an airflow sensor 200, an atomizer 700, a control module 300, a transformer module 600, a manual control module 400 and a lamp display module 500. The control module 300 is electrically connected to the power supply 100, the airflow sensor 200, the atomizer 700, the transformer module 600, and the manual control module 400, respectively. The lamp display module 500 is electrically connected to the transformer module 600.

The lamp display module 500 includes an ash lamp. The lamp display module 500 cam further include an illuminating lamp. In present embodiment, the lamp display module 500 only includes an ash lamp.

The manual control module 400 is used for manually adjusting the brightness of the lamp display module 500.

The power supply 100 is a battery, a high energy capacitor or an external power supply for supplying electric power to the electronic cigarette.

The airflow sensor 200 is used for outputting a corresponding triggering signal to the control module 300 according to a sensed air flow change, thus controlling an operation of the atomizer 700 and a corresponding brightness change of the lamp display module 500.

The manual control module 400 includes a brightness adjustment switch 410 and a smoking switch 420.

The brightness adjustment switch 410 and the smoking switch 420 are electrically connected to the control module, respectively. The brightness adjustment switch 410 can adjust the brightness of the lamp display module 500 only after the smoking switch 420 is turned on.

The only different lies in the first and second embodiments is that the smoking switch 420 should be turned on before using the brightness adjustment switch 410. Accordingly, the second embodiment is not described here for concision.

Comparing with the following third and fourth embodiments, the brightness adjustment of the lamp display module 500 in the first and second embodiments is leapfrogged, which means the brightness differences between each two neighbour brightness levels are the same. This adjustment manner has a relatively fast adjustment speed.

Figure 5:
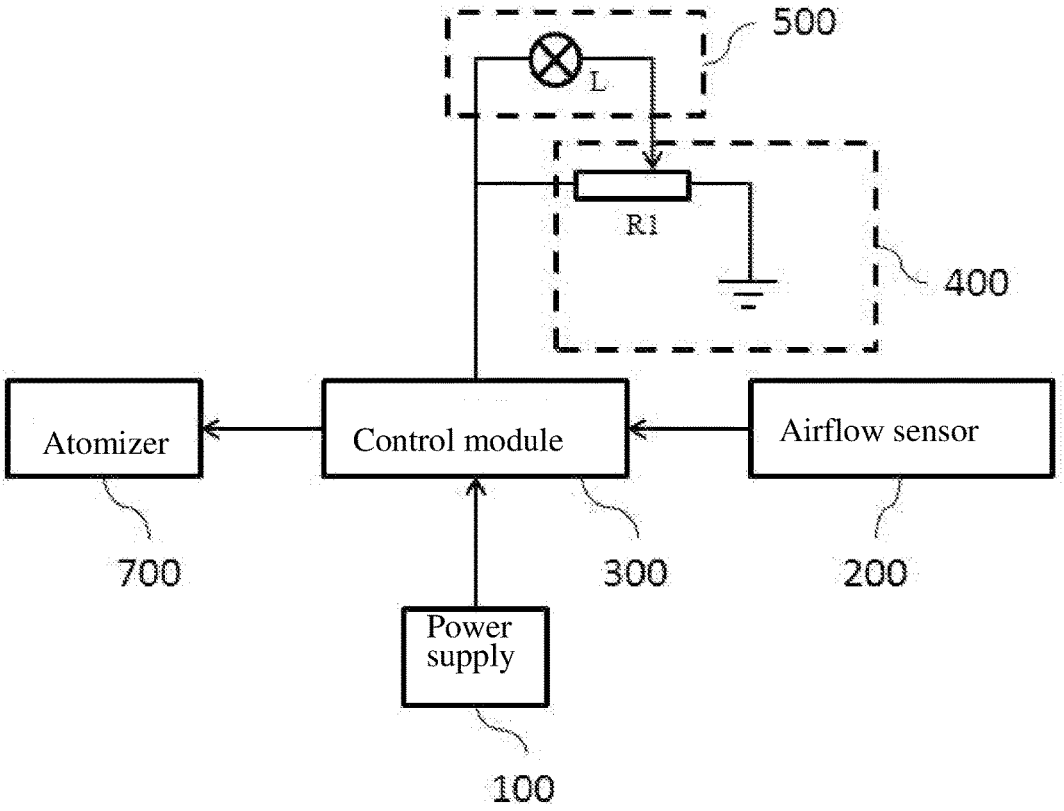
FIG. 5 is a structural diagram of the electronic cigarette with a brightness-adjustable head lamp according to a third embodiment of present application.

FIG. 5 is a structural diagram of the electronic cigarette with a brightness-adjustable head lamp according to a third embodiment of present application.

The electronic cigarette with a brightness-adjustable head lamp of the third embodiment includes a power supply 100, an airflow sensor 200, an atomizer 700, a control module 300, a transformer module 600, a manual control module 400 and a lamp display module 500. The control module 300 is electrically connected to the power supply 100, the airflow sensor 200, the atomizer 700, the transformer module 600, and the manual control module 400, respectively. The lamp display module 500 is electrically connected to the transformer module 600. The manual control module 400 is used for manually adjusting the brightness of the lamp display module 500.

The power supply 100 is a battery, a high energy capacitor or an external power supply for supplying electric power to the electronic cigarette.

The airflow sensor 200 is used for outputting a corresponding triggering signal to the control module 300 according to a sensed air flow change, thus controlling an operation of the atomizer 700 and a corresponding brightness change of the lamp display module 500.

The lamp display module 500 includes an ash lamp L. The manual control module 400 includes a voltage-dividing rheostat R1. One terminal of the voltage-dividing rheostat R1 is connected to one terminal of the control module 300 for receiving the input voltage outputted by control module 300 and one terminal of the ash lamp L, respectively, the other terminal of the voltage-dividing rheostat R1 is grounded. The sliding terminal of the voltage-dividing rheostat R1 is connected to the other terminal of the ash lamp L. The preset sliding terminal of the voltage-dividing rheostat R1 is at the middle of the voltage-dividing rheostat R1.

The voltage-dividing rheostat R1 is used for controlling the voltage actually distributed to the ash lamp L, thus adjusting the brightness of the ash lamp L. The voltage-dividing rheostat R1 can change the voltage distributed to the ash lamp L continuously, which means it can change the brightness of the ash lamp L continuously. Accordingly, comparing with the first and second embodiments, the brightness adjustment of the lamp display module 500 is continuously, which can satisfy the user's personal preference.

If the user feels the whole brightness of the lamp display module 500, that is the whole brightness of the ash lamp L is too strong, he/she can move the sliding terminal of the voltage-dividing rheostat R1 away from the grounded terminal. If the user feels the whole brightness of the ash lamp L is too weak, he/she can move the sliding terminal of the voltage-dividing rheostat R1 towards the grounded terminal. In actual practice, the movement of the sliding terminal can be realized by rotating a knob. For example, a forward rotating of the knob would increase the brightness, and a reverse rotating of the knob would decrease the brightness.

Figure 6:
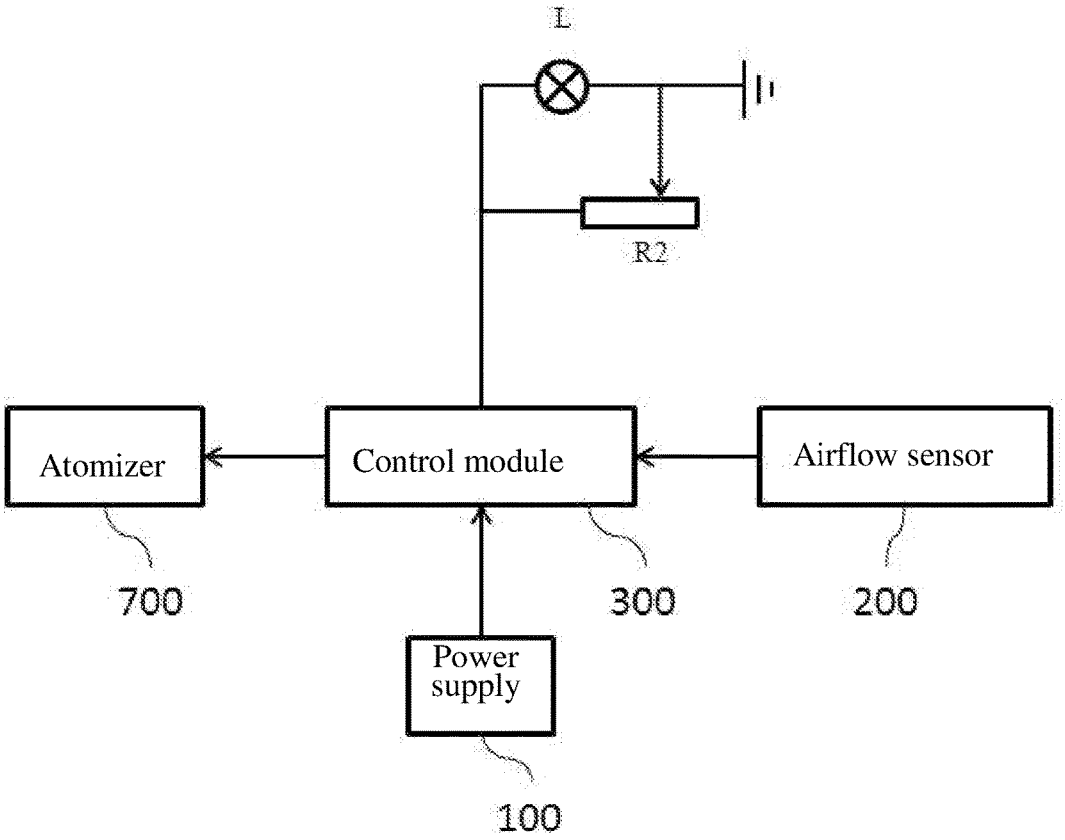
FIG. 6 is a structural diagram of the electronic cigarette with a brightness-adjustable head lamp according to a fourth embodiment of present application.

FIG. 6 is a structural diagram of the electronic cigarette with a brightness-adjustable head lamp according to a fourth embodiment of present application.

The electronic cigarette with a brightness-adjustable head lamp of the fourth embodiment includes a power supply 100, an airflow sensor 200, an atomizer 700, a control module 300, a transformer module 600, a manual control module 400 and a lamp display module 500. The control module 300 is electrically connected to the power supply 100, the airflow sensor 200, the atomizer 700, the transformer module 600, and the manual control module 400, respectively. The lamp display module 500 is electrically connected to the transformer module 600.

The manual control module 400 is used for manually adjusting the brightness of the lamp display module 500.

The power supply 100 is a battery, a high energy capacitor or an external power supply for supplying electric power to the electronic cigarette.

The airflow sensor 200 is used for outputting a corresponding triggering signal to the control module 300 according to a sensed air flow change, thus controlling an operation of the atomizer 700 and a corresponding brightness change of the lamp display module 500.

The lamp display module 500 includes an ash lamp L. The manual control module 400 includes a shunt rheostat R2. One terminal of the shunt rheostat R2 is connected to one terminal of the control module 300 and one terminal of the ash lamp L, respectively, the other terminal of the shunt rheostat R2 is floated. The sliding terminal of the shunt rheostat R2 is grounded. The other end of the lamp display module 500 is connected to the sliding terminal of the shunt rheostat R2. The preset sliding terminal of the shunt rheostat R2 is at the middle of the shunt rheostat R2.

The shunt rheostat R2 is used for controlling the current actually distributed to the lamp display module 500, thus adjusting the brightness of the ash lamp L. The shunt rheostat R2 can change the current distributed to the ash lamp L continuously, which means it can change the brightness of the ash lamp L continuously. Accordingly, comparing with the first and second embodiments, the brightness adjustment of the lamp display module 500 is continuously, which can satisfy the user's personal preference.

If the user feels the whole brightness of the lamp display module 500, that is the whole brightness of the ash lamp L is too strong, he/she can move the sliding terminal of the shunt rheostat R2 away from the floated terminal. If the user feels the whole brightness of the ash lamp L is too weak, he/she can move the sliding terminal of the shunt rheostat R2 towards the floated terminal. In actual practice, the movement of the sliding terminal can be realized by rotating a knob. For example, a forward rotating of the knob would increase the brightness, and a reverse rotating of the knob would decrease the brightness.

The electronic cigarette with a brightness-adjustable head lamp of the fifth embodiment includes a power supply 100, a manual control module 400 and a lamp display module 500. The manual control module 400 is electrically connected to the power supply 100 and the lamp display module 500, respectively.

The manual control module 400 is used for manually adjusting the brightness of the lamp display module 500.

The power supply 100 is a battery, a high energy capacitor or an external power supply for supplying electric power to the electronic cigarette.

The lamp display module 500 includes an ash lamp L. The manual control module 400 includes a voltage-dividing rheostat.

One terminal of the voltage-dividing rheostat is connected to one terminal of the power supply 100 and one terminal of the lamp display module 500, respectively, the other terminal of the voltage-dividing rheostat is grounded. The sliding terminal of the voltage-dividing rheostat is connected to the other terminal of the lamp display module 500. The preset sliding terminal of the voltage-dividing rheostat is at the middle of the voltage-dividing rheostat.

The voltage-dividing rheostat is used for controlling the voltage actually distributed to the lamp display module 500, thus adjusting the brightness of the lamp display module 500. The voltage-dividing rheostat can change the voltage distributed to the lamp display module 500 continuously, which means it can change the brightness of the lamp display module 500 continuously, so as to satisfy the user's personal preference.

If the user feels the whole brightness of the lamp display module 500 is too strong, he/she can move the sliding terminal of the voltage-dividing rheostat away from the grounded terminal. If the user feels the whole brightness of the ash lamp L is too weak, he/she can move the sliding terminal of the voltage-dividing rheostat towards the grounded terminal. In actual practice, the movement of the sliding terminal can be realized by rotating a knob. For example, a forward rotating of the knob would increase the brightness, and a reverse rotating of the knob would decrease the brightness.

The electronic cigarette with a brightness-adjustable head lamp of the sixth embodiment includes a power supply 100, a manual control module 400 and a lamp display module 500. The manual control module 400 is electrically connected to the power supply 100 and the lamp display module 500, respectively.

The manual control module 400 is used for manually adjusting the brightness of the lamp display module 500.

The power supply 100 is a battery, a high energy capacitor or an external power supply for supplying electric power to the electronic cigarette.

The lamp display module 500 includes an ash lamp L. The manual control module 400 includes a shunt rheostat.

One terminal of the shunt rheostat is connected to one terminal of the power supply 100 and one terminal of the lamp display module 500, respectively, the other terminal of the shunt rheostat is floated. The sliding terminal of the shunt rheostat is grounded. The other end of the lamp display module 500 is connected to the sliding terminal of the shunt rheostat. The preset sliding terminal of the shunt rheostat is at the middle of the shunt rheostat.

The shunt rheostat is used for controlling the current actually distributed to the lamp display module 500, thus adjusting the brightness of the lamp display module 500. The shunt rheostat can change the current distributed to the lamp display module 500 continuously, which means it can change the brightness of the lamp display module 500 continuously, so as to satisfy the user's personal preference.

If the user feels the whole brightness of the lamp display module 500 is too strong, he/she can move the sliding terminal of the shunt rheostat away from the floated terminal. If the user feels the whole brightness of the lamp display module 500 is too weak, he/she can move the sliding terminal of the shunt rheostat towards the floated terminal. In actual practice, the movement of the sliding terminal can be realized by rotating a knob. For example, a forward rotating of the knob would increase the brightness, and a reverse rotating of the knob would decrease the brightness.

Based on any one embodiment of the first-six embodiments, an illuminating lamp and a boost module can be arranged in the lamp display module 500, and an illuminating switch can be arranged in the manual control module 400. One terminal of the illuminating switch is connected to one terminal of the ash lamp L for receiving the input voltage or connecting the power supply (that is connected to one terminal of the control module or one terminal of the power supply), the other terminal of the illuminating switch is connected to the input terminal of the boost module, whose output terminal is connected to one terminal of the illuminating lamp. The other terminal of the illuminating lamp is connected to the other terminal of the ash lamp L. If the illuminating switch is turned on, the illuminating lamp works, and meanwhile the brightness of the illuminating lamp can be adjusted by the brightness adjustment switch 410, the voltage-dividing rheostat or the shunt rheostat of the manual control module 400, thus make the electronic cigarette more functional by providing the illuminating lamp.

A brightness adjustment method for an electronic cigarette with a brightness-adjustable head lamp is provided, wherein, the electronic cigarette includes a lamp display module 500 and a manual control module 400, wherein, the brightness adjustment method includes manually adjusting a brightness of the lamp display module 500 via the manual control module 400.

The method further includes automatically controlling the brightness of the lamp display module 500 according to an airflow change sensed by an airflow sensor 200, and then manually adjusting the brightness of the lamp display module 500 via the manual control module 400.

In the method, manually adjusting the brightness of the lamp display module 500 via the manual control module 400 includes direct adjusting and indirect adjusting. The direct adjusting includes sliding a voltage-dividing rheostat R1 or a shunt rheostat R2 to directly adjust the current or voltage of the lamp display module 500. The indirect adjusting includes pressing a brightness adjustment switch 410, and pressing smoking switch 420 at first and then pressing a brightness adjustment switch 410, then adjusting the brightness of the lamp display module 500 via the control module 300.

The foregoing description of the embodiment of the present application has been presented for purpose of illustration and description. It is intended to illustrate the present application rather than limit the application to the precise form disclosed. It should be understood that various changes, substitutions and alterations can be made hereto by one skilled in the art based on the motivation of the present application, without departing from the spirit and scope of the present application as described by the appended claims.

What is claimed is:

1. An electronic cigarette with a brightness-adjustable head lamp including:

a lamp display module arranged at an end of the electronic cigarette;

a manual control module configured for manually adjusting a brightness of the lamp display module;

a control module electrically connected to the manual control module and the lamp display module respectively, wherein the control module is configured for adjusting the brightness of the lamp display module according to an input signal of the manual control module; and a transformer module via which the control module and the lamp display module are electrically connected;

wherein the manual control module includes a brightness adjustment switch electrically connected to the control module, wherein the brightness adjustment switch is configured for triggering the control module outputting a brightness adjustment signal, and the transformer module is configured for adjusting a received input voltage according to the brightness adjustment signal and outputting a same to the lamp display module.

2. The electronic cigarette with a brightness-adjustable head lamp according to claim 1, wherein the transformer module includes a MOS FET of P type and a capacitor, the brightness adjustment signal is a pulse wave signal for controlling the MOS FET to switch on or off, wherein a drain of the MOS FET is connected to an voltage output terminal of the control module for receiving the input voltage, a gate of the MOS FET is connected to a control output terminal of the control module for receiving the pulse wave signal, a source of the MOS FET is connected to one terminal of the capacitor, the other terminal of the capacitor is grounded, and the lamp display module is connected in parallel with the capacitor.

3. The electronic cigarette with a brightness-adjustable head lamp according to claim 2, wherein the manual control module further includes a smoking switch electrically connected to the control module.

4. The electronic cigarette with a brightness-adjustable head lamp according to claim 1, wherein the electronic cigarette further includes a power supply electrically connected to the control module.

5. The electronic cigarette with a brightness-adjustable head lamp according to claim 1, wherein the electronic cigarette further includes an airflow sensor and an atomizer electrically connected to the control module; wherein, the airflow sensor is configured for outputting a corresponding triggering signal to the control module according to a sensed air flow change, thus controlling an operation of the atomizer and a corresponding brightness change of the lamp display module.

6. The electronic cigarette with a brightness-adjustable head lamp according to claim 1, wherein the electronic cigarette further includes a power supply electrically connected to the lamp display module.

7. The electronic cigarette with a brightness-adjustable head lamp according to claim 6, wherein the power supply is a battery, a high energy capacitor or an external power supply for supplying electric power to the electronic cigarette.

8. The electronic cigarette with a brightness-adjustable head lamp according to claim 1, wherein the lamp display module includes an ash lamp and an illuminating lamp, wherein the manual control module further includes an illuminating switch configured for controlling an operation of the illuminating lamp.

9. An electronic cigarette with a brightness-adjustable head lamp including:

a lamp display module arranged at an end of the electronic cigarette;

a manual control module configured for manually adjusting a brightness of the lamp display module; and a power supply electrically connected to the lamp display module;

wherein the manual control module includes a voltage-dividing rheostat with one terminal connected to one terminal of the power supply and one terminal of the lamp display module, respectively, with the other terminal grounded and with a sliding terminal connected to the other terminal of the lamp display module; wherein the voltage-dividing rheostat is configured for controlling a voltage distributed to the lamp display module, thus adjusting the brightness of the lamp display module;

or the manual control module includes a shunt rheostat with one terminal connected to one terminal of the power supply and one terminal of the lamp display module, respectively, with a sliding terminal grounded and connected to the other terminal of the lamp display module; wherein the shunt rheostat is configured for controlling a current distributed to the lamp display module, thus adjusting the brightness of the lamp display module.

10. An electronic cigarette with a brightness-adjustable head lamp including:

a lamp display module arranged at an end of the electronic cigarette;

a manual control module used for manually adjusting a brightness of the lamp display module;

a control module electrically connected to the manual control module and the lamp display module respectively, wherein the control module is configured for adjusting the brightness of the lamp display module according to an input signal of the manual control module; and a power supply electrically connected to the control module;

wherein the manual control module includes a voltage-dividing rheostat with one terminal connected to one terminal of the control module and one terminal of the lamp display module, respectively, with the other terminal grounded and with a sliding terminal connected to the other terminal of the lamp display module; wherein the voltage-dividing rheostat is configured for controlling a voltage distributed to the lamp display module, thus adjusting the brightness of the lamp display module;

or the manual control module includes a shunt rheostat with one terminal connected to one terminal of the control module and one terminal of the lamp display module, respectively, with a sliding terminal grounded and connected to the other terminal of the lamp display module; wherein the shunt rheostat is configured for controlling a current distributed to the lamp display module, thus adjusting the brightness of the lamp display module.

* * * * *